US006972527B2

(12) United States Patent
Su et al.

(10) Patent No.: US 6,972,527 B2
(45) Date of Patent: Dec. 6, 2005

(54) ALTERNATING CURRENT PLASMA DISPLAY PANEL

(75) Inventors: Yao-Ching Su, Taoyuan (TW); Chen-Kwang Pan, Hsinchu (TW)

(73) Assignee: Au Optronics Corporation, Hsinchu (TW)

( * ) Notice: Subject to any disclaimer, the term of this patent is extended or adjusted under 35 U.S.C. 154(b) by 0 days.

(21) Appl. No.: 10/707,456

(22) Filed: Dec. 16, 2003

(65) Prior Publication Data

US 2005/0057172 A1 Mar. 17, 2005

(30) Foreign Application Priority Data

Aug. 20, 2003 (TW) ..... 92122814 A

(51) Int. Cl.[7] ..... G09G 3/10

(52) U.S. Cl. ..... 315/169.4; 315/169.3; 313/581

(58) Field of Search ..... 315/167, 169.3, 315/169.4; 313/581–582, 584–585, 306–307

(56) References Cited

U.S. PATENT DOCUMENTS 5,967,872 A * 10/1999 Betsui et al. ..... 445/24
6,373,195 B1 * 4/2002 Whang et al. ..... 315/169.3
6,498,593 B1 * 12/2002 Fujimoto et al. ..... 345/60
6,512,336 B2 * 1/2003 De Zwart et al. ..... 315/169.3
6,741,031 B2 * 5/2004 Harada et al. ..... 313/582
6,784,617 B2 * 8/2004 Jeong et al. ..... 313/586
2003/0025708 A1 * 2/2003 Irie et al. ..... 345/589

* cited by examiner

*Primary Examiner*—Thuy Vinh Tran
(74) *Attorney, Agent, or Firm*—Jianq Chyun IP Office

(57) ABSTRACT

An alternating current plasma display panel is provided. The alternating current plasma display panel includes a plurality of first sub-pixels, a plurality of second sub-pixels, a plurality of third sub-pixels, a plurality of common data electrodes and a plurality of row electrodes. The first sub-pixels, the second sub-pixels and the third sub-pixels are disposed in a delta configuration. The common data electrodes are disposed below the sub-pixels, and the row electrodes are disposed above the sub-pixels. The amount of the first sub-pixels, the second sub-pixels and the third sub-pixels passed through by each of the common data electrodes are the same. The alternating current plasma display panel can reduce the number of data driving chips and effectively improve the quality of image.

18 Claims, 5 Drawing Sheets

500

ALTERNATING CURRENT PLASMA DISPLAY PANEL

CROSS REFERENCE TO RELATED APPLICATIONS

This application claims the priority benefit of Taiwan application serial no. 92122814, filed on Aug. 20, 2003, the full disclosure of which is incorporated herein by reference.

BACKGROUND OF INVENTION

1. Field of the Invention

This invention generally relates to an alternating current plasma display panel (AC PDP), and more particularly to an alternating current plasma display panel using a common data electrode to effectively improve the display result due to the difference of the total capacitance and to eliminate the flicker effect.

2. Description of Related Art

Flat panel displays are the interface between the users and the data process systems. Currently, flat panel displays include three major categories: plasma displays, organic electro-luminescent displays (OELD), liquid crystal displays (LCD), and light emitting diodes (LED). Plasma displays would probably become the main stream in flat panel displays in the near future because of its large-size, self-light-emitting, non-viewing-angle dependent, light-weight, and full-color features.

A plasma display is a display device using phosphor material. After being exposed to an ultraviolet light, the phosphor material will emit the visible light for display. The light emitting structure includes a pair of electrodes, a discharging gas, and a phosphor material layer. When the voltage between the anode and the cathode reaches the threshold voltage, the discharging gas will discharge to emit the ultraviolet light. The phosphor material layer, after being exposed to the ultraviolet light, will enter into the excited state. In the process of returning to the ground state, the visible light of various colors is emitted based on the materials characteristics.

FIG. 1 is a prospective view of a conventional alternating current plasma display panel. Referring to FIG. 1, the alternating current plasma display panel includes a top substrate 150 and a bottom substrate 110. A dielectric layer 115, a barrier rib 120, and a plurality of data electrodes are disposed on the upper surface of the bottom substrate 110, wherein the data electrodes are disposed on the upper surface of the bottom substrate 110; the dielectric layer 115 is disposed on the upper surface of the upper surface of the bottom substrate 110 and covers the data electrodes 130; the barrier rib 120 is disposed on the dielectric layer 115 to determine a plurality of first pixel areas 140*a*, a plurality of second pixel areas 140*b*, and a plurality of third pixel areas 140*c* arranged in a delta configuration.

The first phosphor layer 142*a* is disposed in the first pixel area 140*a*; the second phosphor layer 142*ba* is disposed in the second pixel area 140*b;* the third phosphor layer 142*c* is disposed in the third pixel area 140*c*. Hence, the first, second, and third phosphor layers 142*a*, 142*b*, and 142*c* emit different visible lights respectively. These phosphor layers are disposed on the sidewall of the barrier rib 120 and on the exposed dielectric layer 115. Each data electrode has a pixel area having the same phosphor material along the X-axis direction.

A plurality of row electrodes 160 and a protective layer 170 are disposed on the bottom surface of the top substrate 150. Each row electrode 160 includes a bus electrode 162 and a sustain electrode 164. The bus electrode 162 is disposed at the top of the barrier rib 120 along the Y-axis direction. The sustain electrode 164 extends a wing-like configuration to the two sides of the bus electrode 162. The protective layer 170 is disposed on the bottom surface of the top substrate 150 and covers the row electrodes 160 to protect the sustain electrode 164 from damage.

Because of the material difference of the phosphor layers, each data electrode has a different capacitance. Hence, while driving the pixel area of the different data lines, and the pixel area has the same material for the phosphor layers, the display result may be different, for example, different driving voltages and different brightness. Flicker effect and lines with different brightness are thereby resulted.

FIG. 2 shows the relationship between the data electrodes and the pixel areas in a conventional alternating current plasma display panel. Referring to FIG. 2, the data electrodes 230 are zigzag configured and disposed between the adjacent columns of pixel areas 240. Because the data electrodes 230 adopt a common electrode design, the amount of the data driving chips can be reduced to reduce the costs of the alternating current plasma display panel. However, the pixel areas 240 that are passed through by the data electrode 230 are disposed with two different phosphor layers. Therefore, this design has the flicker problem because the data electrode still has different capacitance.

SUMMARY OF INVENTION

An object of the present invention is to provide an alternating current plasma display panel using a common data electrode to effectively reduce the amount of the data driving chips and to improve the flicker effect of the pixel areas.

The present invention provides an alternating current plasma display panel, comprising a plurality of pixels, a plurality of common data electrodes, and a plurality of row electrodes, each of the plurality of pixels including a first sub-pixel, a second sub-pixel, and a third sub-pixel arranged in a delta configuration, the first sub-pixel, the second sub-pixel, and the third sub-pixel being for emitting red, green, and blue visible lights respectively, the plurality of common electrodes being disposed below the plurality of pixels, the plurality of row electrodes being disposed above the plurality of pixels.

The characteristics of the present invention are that (a) three of the second sub-pixels and three of the third sub-pixels alternately enclose each of the first sub-pixels, three of the first sub-pixels and three of the third sub-pixels alternately encloses each of the second sub-pixels, and three of the first sub-pixels and three of the second sub-pixels alternately encloses each of the third sub-pixels; (b) each of the plurality of common data electrodes is zigzag or straight arranged and passes a same amount of the first sub-pixels, the second sub-pixels, and the third sub-pixels.

The present invention also provides an alternating current plasma display panel, comprising a plurality of pixels, a plurality of common data electrodes, and a plurality of row electrodes, each of the plurality of pixels including three sub-pixels such as red, green, and blue sub-pixels arranged in a delta configuration, the three sub-pixels being for emitting red, green, and blue visible lights respectively, the plurality of common electrodes being disposed below the plurality of sub-pixels, the plurality of row electrodes being disposed above the plurality of sub-pixels.

The characteristics of the present invention are that (a) the sub-pixels are arranged so that each row of the sub-pixels is for emitting a same visible light and two adjacent rows are for emitting different visible lights; (b) each of the plurality of common data electrodes is zigzag or straight arranged and passes through each row of the sub-pixels.

The present invention further provides an alternating current plasma display panel, comprising a plurality of pixels, a plurality of common data electrodes, and a plurality of row electrodes, each of the plurality of pixels including a first sub-pixel, a second sub-pixel, and a third sub-pixel arranged in a delta configuration, the first sub-pixel, the second sub-pixel, and the third sub-pixel being for emitting red, green, and blue visible lights respectively, the plurality of common electrodes being disposed below the plurality of pixels, the plurality of row electrodes being disposed above the plurality of pixels.

The characteristics of the present invention are that (a) each row of sub-pixels is arranged with the first sub-pixels, the second sub-pixels, and the third sub-pixels in a cyclic order, only one of six sub-pixels enclosing one of the first pixels is a first pixel, only one of six sub-pixels enclosing one of the second pixels is a second pixel, and only one of six sub-pixels enclosing one of the third pixels is a third pixel; (b) each of the plurality of common data electrodes is zigzag or straight arranged and passing through a same amount of the first sub-pixels, the second sub-pixels, and the third sub-pixels.

In a preferred embodiment of the present invention, the sub-pixels are hexagonal and are honeycombed arranged; the sub-pixels also can be rectangular, polygonal, or round. Each of the plurality of row electrodes includes a bus electrode and a sustain electrode, wherein the material of the sustain electrode includes a transparent conducting material.

In brief, the present invention uses a common data electrode design to effectively reduce the amount of the data driving chips and to improve the flicker effect of the pixel areas because each common data electrode has the same capacitance.

The above is a brief description of some deficiencies in the prior art and advantages of the present invention. Other features, advantages and embodiments of the invention will be apparent to those skilled in the art from the following description, accompanying drawings and appended claims.

DETAILED DESCRIPTION

Figure 1:
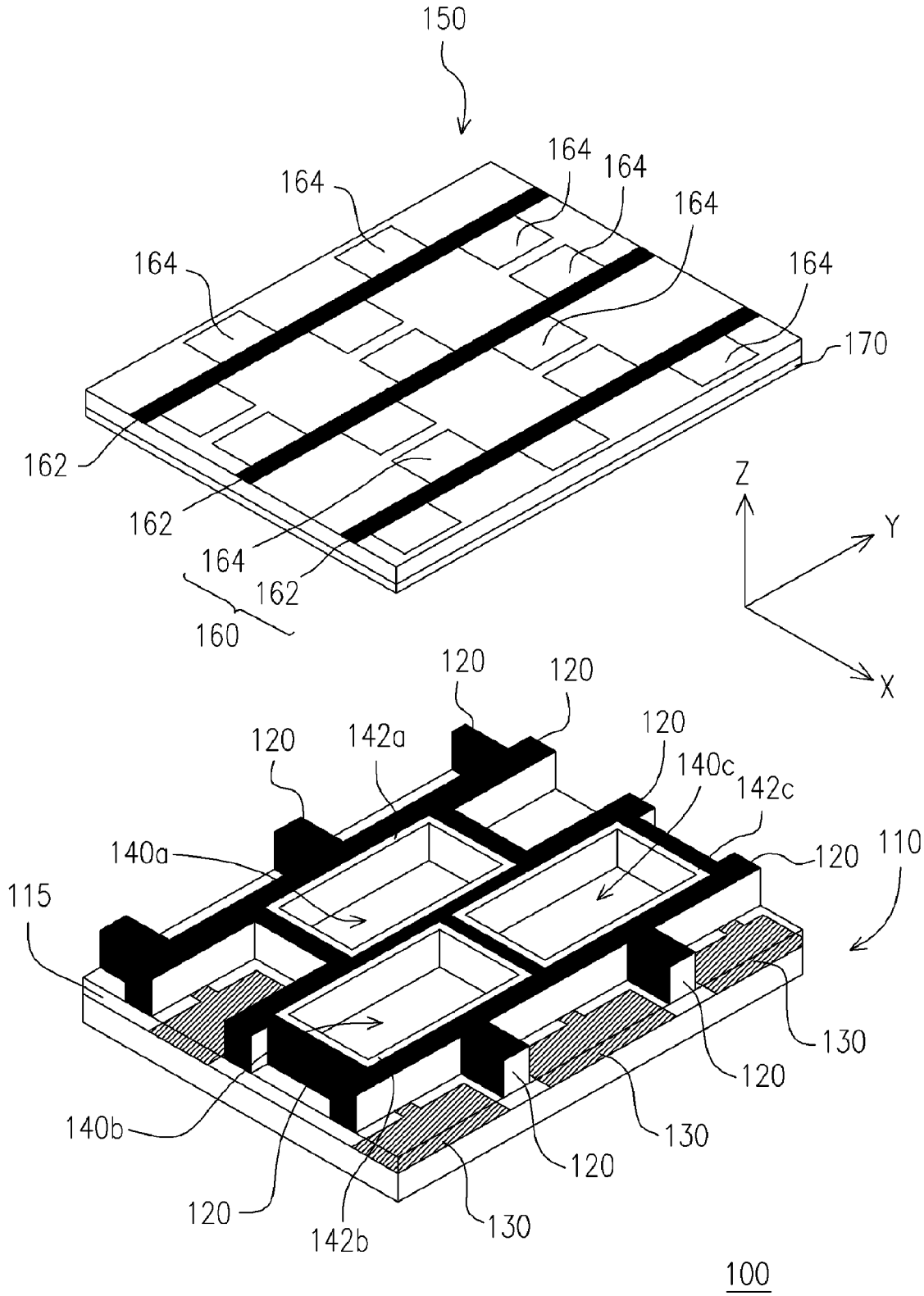
FIG. 1 (PRIOR ART)
FIG. 1 is a prospective view of a conventional alternating current plasma display panel.
Figure 2:
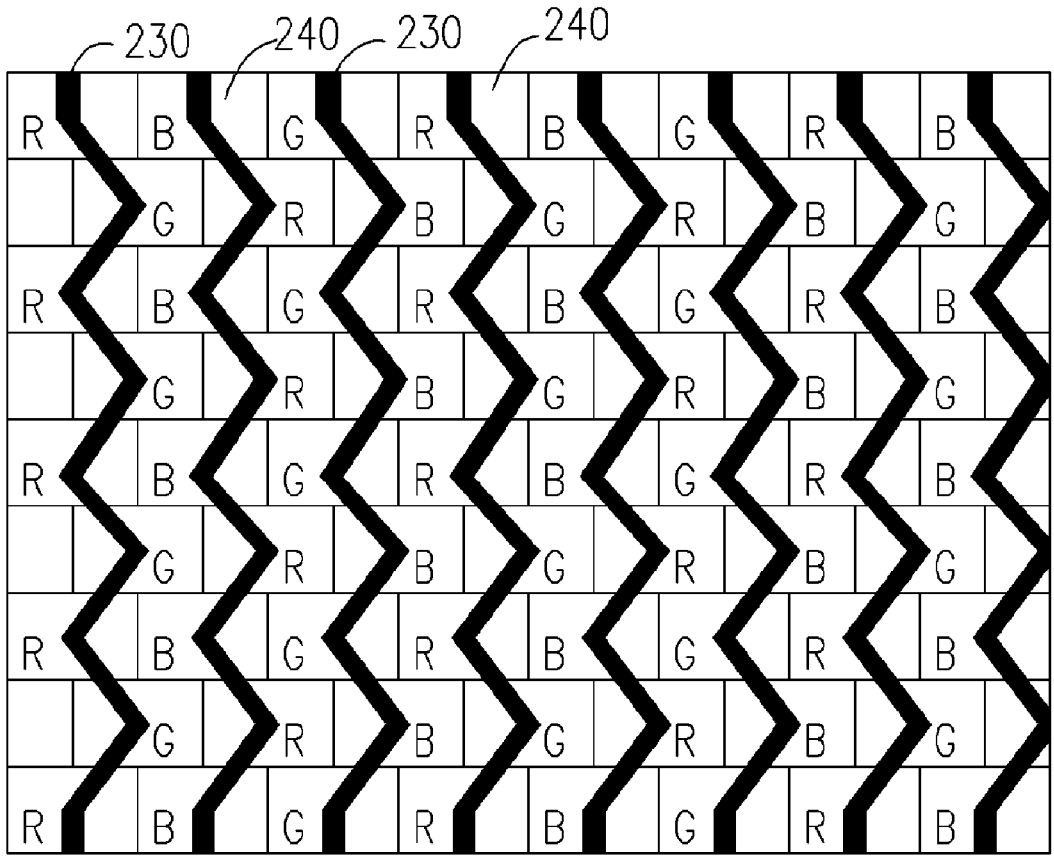
FIG. 2 (PRIOR ART)
FIG. 2 shows the relationship between the data electrodes and the pixel areas in a conventional alternating current plasma display panel.
Figure 3:
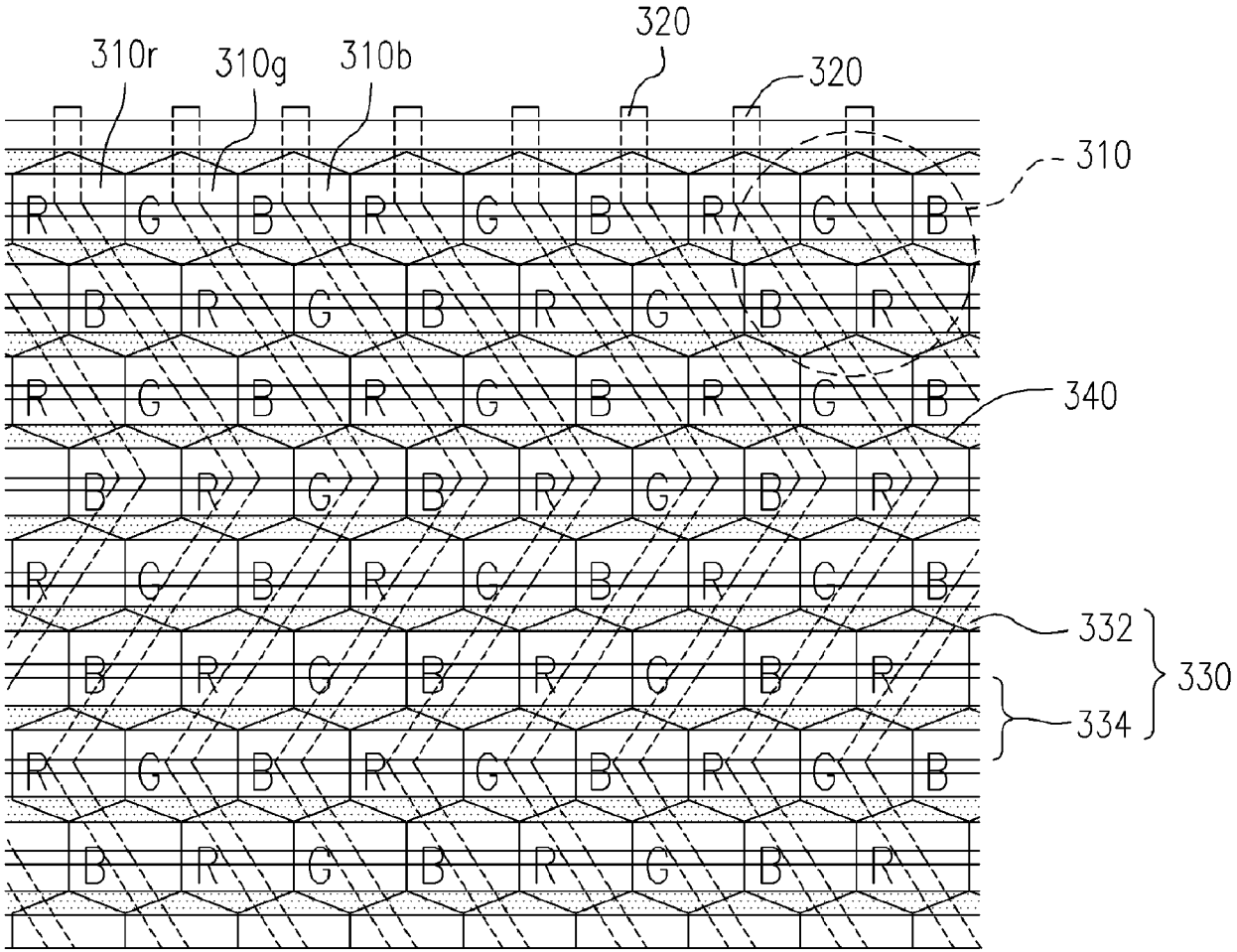
FIG. 3 is a top view of an alternating current plasma display panel in accordance with the first embodiment of the present invention.

FIG. 3 is a top view of an alternating current plasma display panel in accordance with the first embodiment of the present invention. Referring to FIG. 3, the alternating current plasma display panel 300 comprises a plurality of pixels 310, a plurality of common data electrodes 320, and a plurality of row electrodes 330. Each of the plurality of pixels 310 includes a first sub-pixel 310*r*, a second sub-pixel 310*g*, and a third sub-pixel 310*b* arranged in a delta configuration. The plurality of common electrodes 320 are disposed below the plurality of pixels 310, and the plurality of row electrodes 330 are disposed above the plurality of pixels 310.

The discharging gas and the different phosphor layers are disposed inside the first sub-pixels 310*r*, the second sub-pixels 310*g*, and the third sub-pixels 310*b*. Hence, by applying a voltage to the pixel through the common data electrodes 320 and the row electrodes 330, the discharging gas will emit the ultraviolet light. Then the ultraviolet light excites the phosphor layers to make the first sub-pixel 310*r* to emit red visible light, the second sub-pixel 310*g* to emit green visible light, and the third sub-pixel 310*b* to emit blue visible light.

The characteristics of the alternating current plasma display panel 300 are that (a) three of the second sub-pixels 310*g* and three of the third sub-pixels 310*b* alternately enclose each first sub-pixel 310*r*, three of the first sub-pixels 310*r* and three of the third sub-pixels 310*b* alternately enclose each second sub-pixel 310*g*, and three of the first sub-pixels 310*r* and three of the second sub-pixels 310*g* alternately enclose each third sub-pixel 310*b*; (b) each of the plurality of common data electrodes 320 is zigzag or straight arranged and passes through the same amount of the first sub-pixels 310*r*, the second sub-pixels 310*g*, and the third sub-pixels 310*b*.

Further, the shapes of the first sub-pixels 310*r*, the second sub-pixels 310*g*, and the third sub-pixels 310*b* are determined by, for example, the barrier rib 340. The shapes can be hexagonal and the first sub-pixels 310*r*, the second sub-pixels 310*g* are honeycombed arranged. The shapes also can be rectangular, polygonal, or round. Each of the plurality of row electrodes 330 includes a bus electrode 332 and a sustain electrode 334. The row electrode 330 can be a scanning line or a common line based on the application, wherein the material of the sustain electrode 334 includes a transparent conducting material, such as, indium tin oxide (ITO).

As mentioned above, because each common data electrode 320 passes through the same amount of the first sub-pixels 310*r*, the second sub-pixels 310*g*, and the third sub-pixels 310*b*, the total capacitance of each common data electrode 320 is very close. Therefore, the driving characteristics of the pixel area driven by each common data electrode 320 are almost the same, which prevents the pixel area from flicker effect. Further, because the alternating current plasma display panel 300 uses common date electrodes, the number of the data electrodes and the data driving chips is reduced, thereby curtailing the costs of the alternating current plasma display panel.

Figure 4:
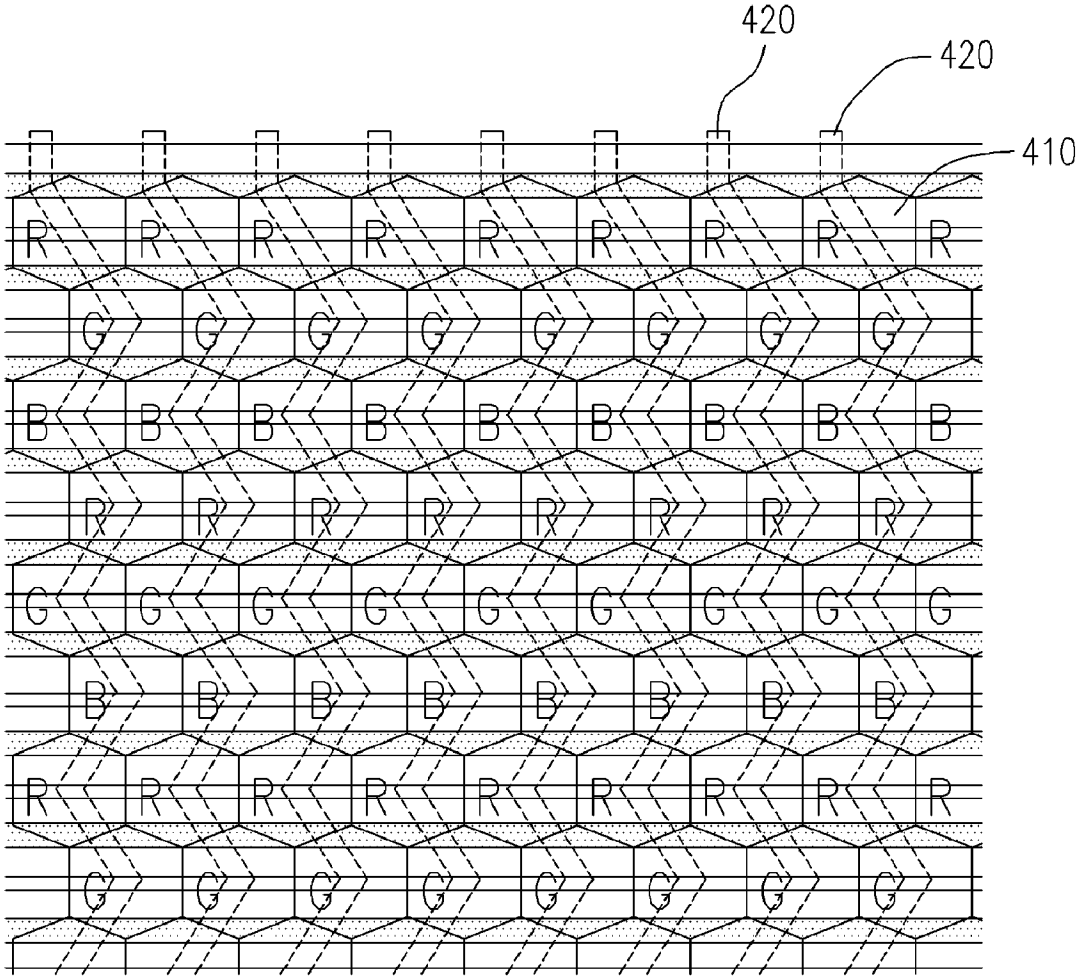
FIG. 4 is a top view of an alternating current plasma display panel in accordance with the second embodiment of the present invention.

FIG. 4 is a top view of an alternating current plasma display panel in accordance with the second embodiment of the present invention. Referring to FIG. 4, the major difference between the first and second embodiments is that the sub-pixels and the common data electrodes 420 are disposed in a different way. The characteristics of the alternating current plasma display panel 400 are that (a) the sub-pixels are arranged so that each row of the sub-pixels 410 is for emitting a same visible light and two adjacent rows of the sub-pixels 410 are for emitting different visible lights; (b) each of the plurality of common data electrodes 420 is zigzag or straight arranged and passes each row of the sub-pixels 410. Further, the alternating current plasma display panel 400 also provides the same advantages as the first embodiment.

Figure 5:
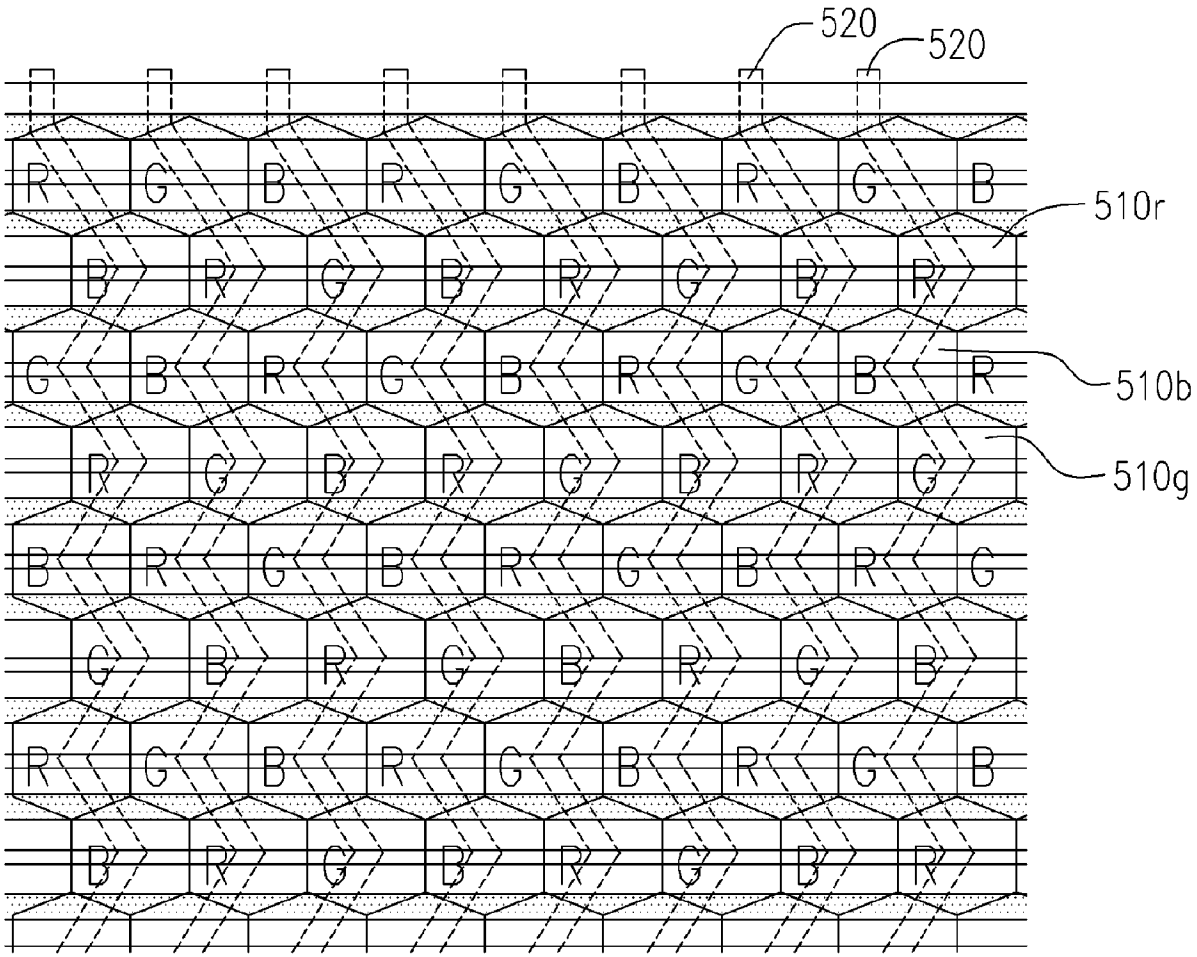
FIG. 5 is a top view of an alternating current plasma display panel in accordance with the third embodiment of the present invention.

FIG. 5 is a top view of an alternating current plasma display panel in accordance with the third embodiment of the present invention. Referring to FIG. 5, the major difference between this embodiment and the first and second embodiments is that the sub-pixels 5104, 501*g*, 510*b* and the common data electrodes 520 are disposed in a different way. The characteristics of the alternating current plasma display panel 500 are that (a) each row of sub-pixels are arranged with the first sub-pixels 510*r*, the second sub-pixels 510*g*, and the third sub-pixels 510*b* in a cyclic order, only one of six sub-pixels enclosing one of the first pixels 510*r* is a first pixel 510*r*, only one of six sub-pixels enclosing one of the second pixels 510*g* is a second pixel 510*g*, and only one of six sub-pixels enclosing one of the third pixels 510*b* is a third pixel 510*b*; (b) each of the plurality of common data electrodes 520 is zigzag or straight arranged and passes through the same amount of the first sub-pixels 510*r*, the second sub-pixels 510*g*, and the third sub-pixels 510*b*. Further, the alternating current plasma display panel 400 also provides the same advantages as the first embodiment.

It should be noted that in the above three embodiments, each common data electrode passes through the same amount of the first sub-pixels, the second sub-pixels, and the third sub-pixels. Hence, each common data electrode has almost the same capacitance. Therefore, the arrangement of the common electrodes and the sub-pixels are not limited to the above embodiments. The other arrangements also are within the scope of the invention if they are arranged so that each common data electrode passes through the same amount of the first sub-pixels, the second sub-pixels, and the third sub-pixels.

In brief, the alternating current plasma display panel in accordance with the above embodiments of the present invention can effectively reduce the amount of the data driving chips, improve the flicker effect of the pixel areas, and provide a more stable image output.

The above description provides a full and complete description of the preferred embodiments of the present invention. Various modifications, alternate construction, and equivalent may be made by those skilled in the art without changing the scope or spirit of the invention. Accordingly, the above description and illustrations should not be construed as limiting the scope of the invention which is defined by the following claims.

What is claimed is:

1. An alternating current plasma display panel, comprising a plurality of pixels, a plurality of common data electrodes, and a plurality of row electrodes, each of said plurality of pixels including a first sub-pixel, a second sub-pixel, and a third sub-pixel arranged in a delta configuration, said first sub-pixel, said second sub-pixel, and said third sub-pixel being for emitting different visible lights respectively, said plurality of common data electrodes being disposed below said plurality of pixels, said plurality of row electrodes being disposed above said plurality of pixels; wherein three of said second sub-pixels and three of said third sub-pixels alternately enclose each of said first sub-pixels, three of said first sub-pixels and three of said third sub-pixels alternately enclose each of said second sub-pixels, and three of said first sub-pixels and three of said second sub-pixels alternately enclose each of said third sub-pixels; and each of said plurality of common data electrodes is zigzag or straight arranged and passes through a same amount of said first sub-pixels, said second sub-pixels, and said third sub-pixels.

2. The alternating current plasma display panel of claim 1, wherein each of said first sub-pixels, said second sub-pixels, and said third sub-pixels has a hexagonal shape, and said first sub-pixels, said second sub-pixels, and said third sub-pixels are arranged in a honeycombed pattern.

3. The alternating current plasma display panel of claim 1, wherein each of said first sub-pixels, said second sub-pixels, and said third sub-pixels has a rectangular, polygonal, or round shape.

4. The alternating current plasma display panel of claim 1, wherein each of said plurality of row electrodes includes a bus electrode and a sustain electrode.

5. The alternating current plasma display panel of claim 4, wherein a material of said sustain electrode includes a transparent conducting material.

6. The alternating current plasma display panel of claim 1, wherein said first sub-pixels, said second sub-pixels, and said third sub-pixels are for emitting red, green, and blue visible lights, respectively.

7. An alternating current plasma display panel, comprising a plurality of pixels, a plurality of common data electrodes, and a plurality of row electrodes, each of said plurality of pixels including three sub-pixels arranged in a delta configuration, said three sub-pixels being for emitting different visible lights respectively, said plurality of common electrodes being disposed below said plurality of sub-pixels, said plurality of row electrodes being disposed above said plurality of sub-pixels, wherein said sub-pixels are arranged so that each row of said sub-pixels is for emitting a same visible light and two adjacent rows are for emitting different visible lights; and each of said plurality of common data electrodes is zigzag or straight arranged and passes through said each row of said sub-pixels.

8. The alternating current plasma display panel of claim 7, wherein each of said sub-pixels has a hexagonal shape and said sub-pixels are arranged in a honeycombed pattern.

9. The alternating current plasma display panel of claim 7, wherein each of said sub-pixels has a rectangular, polygonal, or round shape.

10. The alternating current plasma display panel of claim 7, wherein each of said plurality of row electrodes includes a bus electrode and a sustain electrode.

11. The alternating current plasma display panel of claim 10, wherein a material of said sustain electrode includes a transparent conducting material.

12. The alternating current plasma display panel of claim 7, wherein said each row of said sub-pixels is for emitting one of red, green, and blue visible lights.

13. An alternating current plasma display panel, comprising a plurality of pixels, a plurality of common data electrodes, and a plurality of row electrodes, each of said plurality of pixels including a first sub-pixel, a second sub-pixel, and a third sub-pixel arranged in a delta configuration, said first sub-pixel, said second sub-pixel, and said third sub-pixel being for emitting different visible lights respectively, said plurality of common data electrodes being disposed below said plurality of pixels, said plurality of row electrodes being disposed above said plurality of pixels; wherein each row of said sub-pixels is arranged with said first sub-pixels, said second sub-pixels, and said third sub-pixels in a cyclic order, only one of six sub-pixels enclosing one of said first pixels is a first pixel, only one of six sub-pixels enclosing one of said second pixels is a second pixel, and only one of six sub-pixels enclosing one of said third pixels is a third pixel; and each of said plurality of common data electrodes is zigzag or straight arranged and passing through a same amount of said first sub-pixels, said second sub-pixels, and said third sub-pixels.

14. The alternating current plasma display panel of claim 13, wherein each of said first sub-pixels, said second sub-pixels, and said third sub-pixels has a hexagonal shape, and said first sub-pixels, said second sub-pixels, and said third sub-pixels are arranged in a honeycombed pattern.

15. The alternating current plasma display panel of a claim 13, wherein each of said first sub-pixels, said second sub-pixels, and said third sub-pixels has a rectangular, polygonal, or round shape.

16. The alternating current plasma display panel of claim 13, wherein each of said plurality of row electrodes includes a bus electrode and a sustain electrode.

17. The alternating current plasma display panel of claim 16, wherein a material of said sustain electrode includes a transparent conducting material.

18. The alternating current plasma display panel of claim 16, wherein said first sub-pixels, said second sub-pixels, and said third sub-pixels are for emitting red, green, and blue visible lights, respectively;

forming an organic light-emitting layer; and defining the organic light-emitting layer to form a plurality of openings thereon, wherein the openings expose the interconnection regions.

* * * * *